US008416920B2

(12) United States Patent
Okumura et al.

(10) Patent No.: US 8,416,920 B2
(45) Date of Patent: Apr. 9, 2013

(54) TARGET FOR X-RAY GENERATION, X-RAY GENERATOR, AND METHOD FOR PRODUCING TARGET FOR X-RAY GENERATION

(75) Inventors: Katsuya Okumura, Tokyo (JP); Katsuji Kadosawa, Tokyo (JP); Tomofumi Kiyomoto, Takatsuki (JP); Motohiro Suyama, Hamamatsu (JP); Atsushi Ishii, Hamamatsu (JP)

(73) Assignees: Tokyo Electron Limited, Tokyo (JP); Hamamatsu Photonics K.K., Hamamatsu-shi, Shizuoka (JP)

( * ) Notice: Subject to any disclaimer, the term of this patent is extended or adjusted under 35 U.S.C. 154(b) by 237 days.

(21) Appl. No.: 12/871,192

(22) Filed: Aug. 30, 2010

(65) Prior Publication Data

US 2011/0058655 A1 Mar. 10, 2011

(30) Foreign Application Priority Data

Sep. 4, 2009 (JP) ..... P2009-204891

(51) Int. Cl.
*H01J 35/08* (2006.01)

(52) U.S. Cl. ..... 378/143

(58) Field of Classification Search ..... 378/143
See application file for complete search history.

(56) References Cited

U.S. PATENT DOCUMENTS

| | | | |
|---|---|---|---|
| 5,148,462 | A | 9/1992 | Spitsyn et al. |
| 5,657,365 | A | 8/1997 | Yamamoto et al. |
| 6,850,598 | B1 | 2/2005 | Fryda et al. |
| 2004/0165699 | A1 | 8/2004 | Rusch et al. |

FOREIGN PATENT DOCUMENTS

| | | |
|---|---|---|
| JP | 2001-216927 | 8/2001 |
| JP | 2004-028845 | 1/2004 |

*Primary Examiner* — Jurie Yun

(74) *Attorney, Agent, or Firm* — Drinker Biddle & Reath LLP

(57) ABSTRACT

A target for X-ray generation has a substrate and a target portion. The substrate is comprised of diamond and has a first principal surface and a second principal surface opposed to each other. A bottomed hole is formed from the first principal surface side in the substrate. The target portion is comprised of a metal deposited from a bottom surface of the hole toward the first principal surface. An entire side surface of the target portion is in close contact with an inside surface of the hole.

15 Claims, 13 Drawing Sheets

(a)

(b)

(c)

(a)

(b)

(c)

(a)

(b)

TARGET FOR X-RAY GENERATION, X-RAY GENERATOR, AND METHOD FOR PRODUCING TARGET FOR X-RAY GENERATION

BACKGROUND OF THE INVENTION

1. Field of the Invention

The present invention relates to a target for X-ray generation (which will be referred to hereinafter as an X-ray generation target) and a production method thereof, and an X-ray generator with the X-ray generation target.

2. Related Background Art

There is a known X-ray generation target provided with a substrate, and a target portion buried in the substrate (e.g., cf. Japanese Patent Application Laid-open No. 2004-028845). In the X-ray generation target described in Japanese Patent Application Laid-open No. 2004-028845, a single columnar metal wire of tungsten or molybdenum is buried in the substrate comprised of a light element such as beryllium or carbon.

SUMMARY OF THE INVENTION

For obtaining the X-ray generation target in which the metal wire is buried in the substrate, it is conceivable to form a hole in the substrate and insert the metal wire into the hole. In this case, however, the side surface of the metal wire is not always in close contact with the inside surface of the hole and a gap can be made between the side surface of the metal wire and the inside surface of the hole. If the gap is made between the side surface of the metal wire and the inside surface of the hole, it will impede thermal conduction from the metal wire to the substrate. As a result, heat dissipation from the metal wire will become insufficient and it can make the metal wire of the target portion more likely to waste.

In the configuration wherein the metal wire is buried in the substrate, it is difficult to easily form the nanosized target portion in the substrate.

It is an object of the present invention to provide an X-ray generation target with improved heat dissipation from the target portion, an X-ray generator, and a method for producing the X-ray generation target.

An X-ray generation target according to the present invention comprises: a substrate comprised of diamond and having first and second principal surfaces opposed to each other and a bottomed hole formed from the first principal surface; a target portion comprised of a metal deposited from a bottom surface of the hole toward the first principal surface and having a side surface wholly in close contact with an inside surface of the hole.

In the X-ray generation target according to the present invention, since the substrate is comprised of diamond, the substrate itself is excellent in thermal conductivity or heat dissipation and also excellent in stability under high temperature. The target portion is comprised of the metal deposited from the bottom surface of the bottomed hole formed in the substrate, toward the first principal surface; one end face thereof is entirely in close contact with the bottom surface of the hole and the side surface of the target portion is entirely in close contact with the inside surface of the hole; therefore, there is no hindrance to thermal conduction from the metal forming the target portion, to the substrate. As a result of these, improvement is achieved in heat dissipation from the target portion.

The target portion is formed so that in a cross section parallel to a direction in which the first and second principal surfaces are opposed, a length of the target portion in the direction in which the first and second principal surfaces are opposed is set to be not less than a length thereof in a direction perpendicular to the direction in which the first and second principal surfaces are opposed. In this case, it is feasible to achieve improvement in heat dissipation while reducing the focal-spot size (focal-spot diameter) determined by the size of the target portion.

An electrically conductive layer may be formed on the first principal surface of the substrate. In this case, it is feasible to achieve improvement in heat dissipation on the first principal surface side of the substrate and to prevent electrification (charge-up) that can occur upon incidence of electrons to the first principal surface side of the substrate.

A protecting layer containing a transition element, preferably a protecting layer containing a first transition element, may be formed on the first principal surface of the substrate. In this case, the substrate can be protected from an electron beam.

An X-ray generator according to the present invention comprises: the aforementioned X-ray generation target; and an electron beam applying unit which applies an electron beam to the X-ray generation target.

In the X-ray generator according to the present invention, improvement is achieved in heat dissipation from the target portion because the substrate is comprised of diamond and because one end face of the target portion is entirely in close contact with the bottom surface of the hole while the side surface thereof is entirely in close contact with the inside surface of the hole, as described above.

A method for producing an X-ray generation target according to the present invention comprises: a step of preparing a substrate comprised of diamond and having first and second principal surfaces opposed to each other; a step of forming a bottomed hole from the first principal surface in the substrate; a step of depositing a metal from a bottom surface of the hole toward the first principal surface to form a target portion in the hole.

In the method for producing the X-ray generation target according to the present invention, the target portion is formed in the substrate in a state in which the bottom surface thereof is entirely in close contact with the bottom surface of the hole formed in the substrate comprised of diamond and in which the side surface is entirely in close contact with the inside surface of the hole. As a result of this, the X-ray generation target with improved heat dissipation from the target portion can be readily obtained.

The step to form the target portion may comprise applying a charged beam, preferably an ion beam, to the hole in a metal vapor atmosphere to deposit the metal. In this case, the target portion wherein the inside surface thereof is in close contact with the bottom surface of the hole can be securely formed.

The step of forming the hole may comprise applying a charged beam, preferably an ion beam, to the substrate from the first principal surface side to form the hole. In this case, the hole can be made in the substrate with a device used in the step of forming the target portion, which can simplify production facilities and steps.

The present invention successfully provides the X-ray generation target with improved heat dissipation from the target portion, the X-ray generator, and the method for producing the X-ray generation target.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description, identical elements or elements with identical functionality will be denoted by the same reference symbols, without redundant description.

Figure 1:
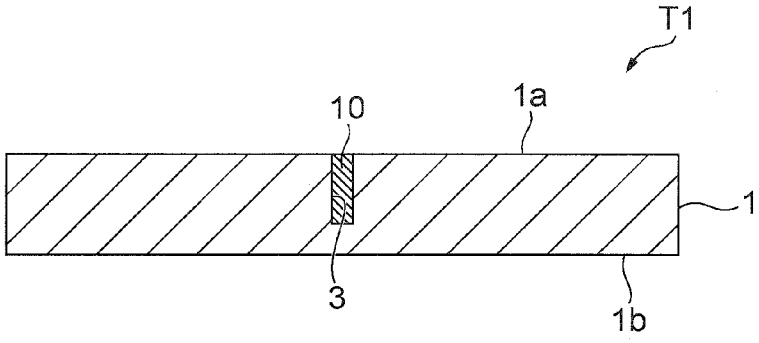
FIG. 1 is a drawing for explaining a cross-sectional configuration of an X-ray generation target according to an embodiment of the present invention.
Figure 2:
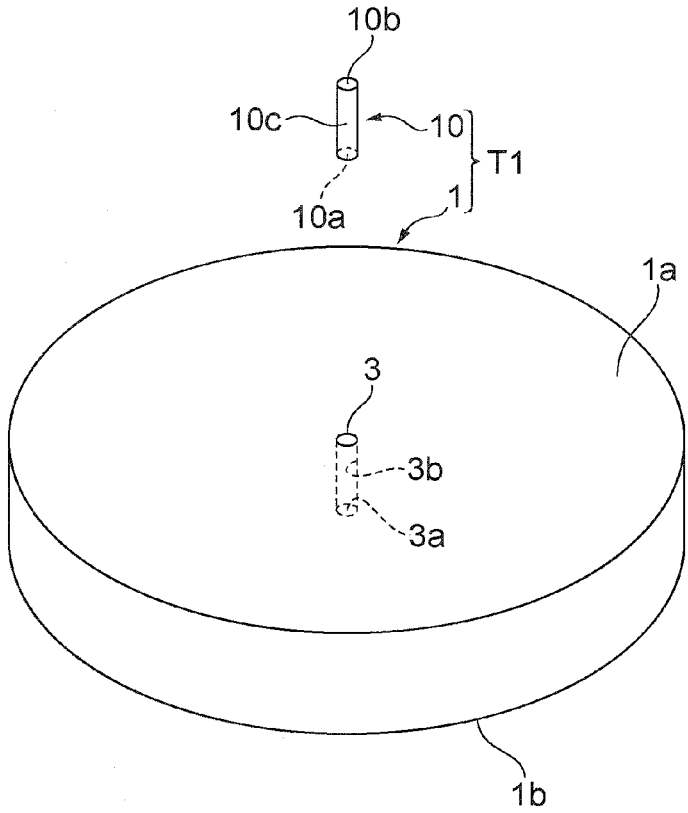
FIG. 2 is an exploded perspective view of the X-ray generation target according to the embodiment.

An X-ray generation target T1 according to an embodiment of the present invention will be described with reference to FIGS. 1 and 2. FIG. 1 is a drawing for explaining a cross-sectional configuration of the X-ray generation target according to the present embodiment. FIG. 2 is an exploded perspective view of the X-ray generation target according to the present embodiment.

The X-ray generation target T1, as shown in FIGS. 1 and 2, is provided with a substrate 1 and a target portion 10.

The substrate 1 is comprised of diamond and has a disk shape. The substrate 1 has first and second principal surfaces 1*a*, 1*b* opposed to each other. The substrate 1 does not always have to be limited to the disk shape but can have any shape, e.g., a rectangular plate shape. The thickness of the substrate 1 is set, for example, to about 100 μm. The outside diameter of the substrate 1 is set, for example, to about 3 mm.

A bottomed hole 3 is made from the first principal surface 1*a* in the substrate 1. The hole 3 has an interior space defined by a bottom surface 3*a* and an inside surface 3*b* and the interior space is of a columnar shape. The interior space of the hole 3 does not always have to be limited to the columnar shape but may have any other shape, e.g., prismatic shape. The inside diameter of the hole 3 is set to about 100 nm and the depth of the hole 3 is set to about 1 μm.

The target portion 10 is disposed in the hole 3 made in the substrate 1. The target portion 10 is made of metal and in a columnar shape corresponding to the interior space of the hole 3. The target portion 10 has first and second end faces 10*a*, 10*b* opposed to each other, and a side surface 10*c*. The metal making up the target portion 10 is, for example, tungsten, gold, platinum, or the like.

The target portion 10 is constructed by depositing the metal in the hole from the bottom surface 3*a* of the hole 3 toward the first principal surface 1*a*. Therefore, the first end face 10*a* of the target portion 10 is in close contact with the bottom surface 3*a* of the hole 3 in its entirety. The side surface 10*c* of the target portion 10 is in close contact with the inside surface 3*b* of the hole 3 in its entirety.

The target portion 10 has the following dimensions corresponding to the shape of the interior space of the hole 3: in a cross section parallel to the direction in which the first and second principal surfaces 1*a*, 1*b* are opposed (or in the thickness direction of the substrate 1), the length in the direction in which the first and second principal surfaces 1*a*, 1*b* are opposed is not less than the length in the direction perpendicular to the direction in which the first and second principal surfaces 1*a*, 1*b* are opposed. In the present embodiment, the length of the target portion 10 in the direction in which the first and second principal surfaces 1*a*, 1*b* are opposed is approximately 1 μm and the length of the target portion 10 in the direction perpendicular to the direction in which the first and second principal surfaces 1*a*, 1*b* are opposed, i.e., the outside diameter of the target portion 10 is approximately 100 nm. The target portion 10 is nanosized.

Figure 3:
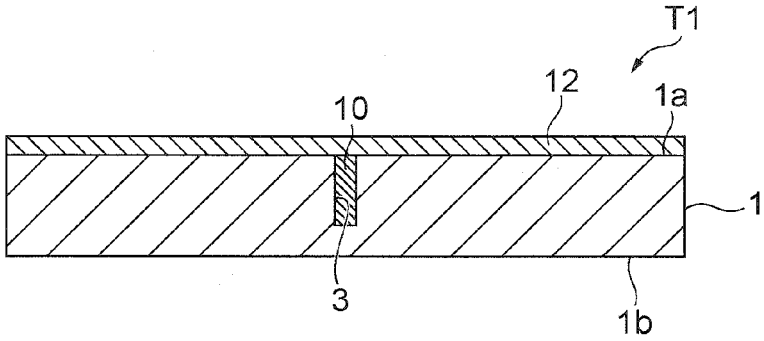
FIG. 3 is a drawing for explaining a cross-sectional configuration of the X-ray generation target according to the embodiment.
Figure 4:
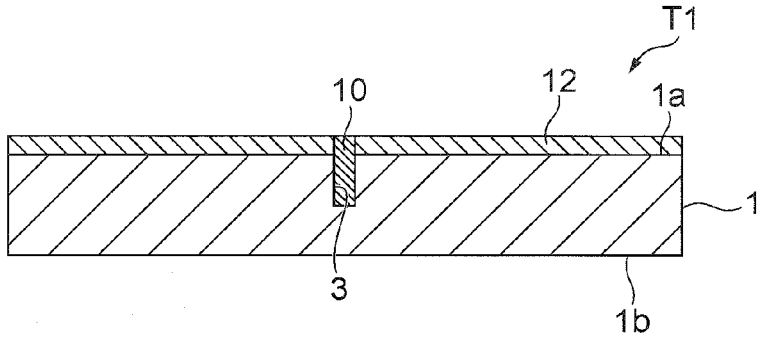
FIG. 4 is a drawing for explaining a cross-sectional configuration of the X-ray generation target according to the embodiment.

The X-ray generation target T1 may have an electrically conductive layer 12, as shown in FIGS. 3 and 4. The conductive layer 12 is formed on the first principal surface 1*a* side of the substrate 1. The conductive layer 12 is comprised, for example, of diamond doped with an impurity (e.g., boron or the like). The thickness of the conductive layer 12 is, for example, about 50 nm.

The conductive layer 12 shown in FIG. 3 is formed on the first principal surface 1*a* so as to cover the first principal surface 1*a* of the substrate 1 and the second end face 10*b* of the target portion 10. The conductive layer 12 shown in FIG. 4 is formed on the first principal surface 1*a* so as to expose the second end face 10*b* of the target portion 10.

Figure 5:
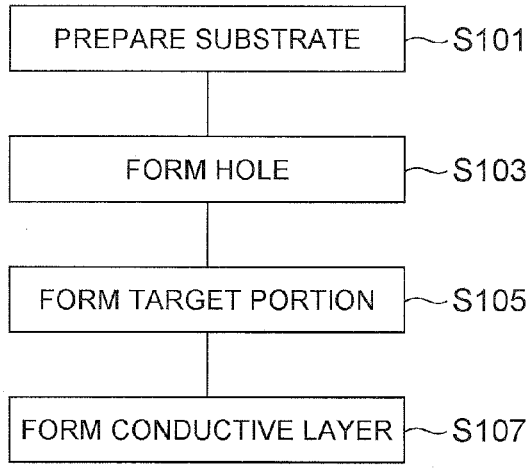
FIG. 5 is a flowchart for explaining a method for producing the X-ray generation target according to the embodiment.
Figure 6:
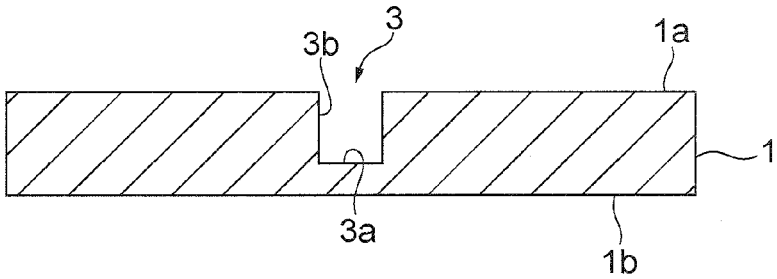
FIG. 6 is a schematic diagram for explaining the method for producing the X-ray generation target according to the embodiment.
Figure 6:
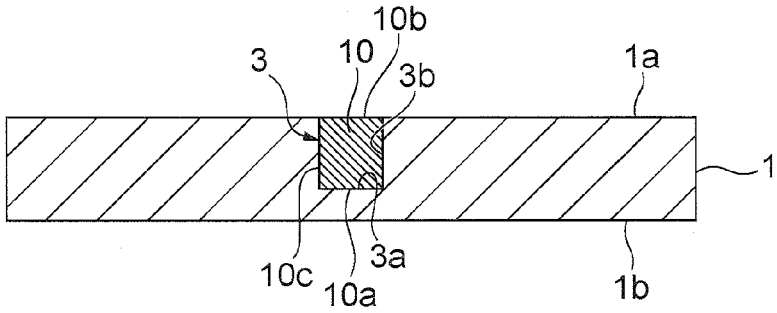
Figure 6:
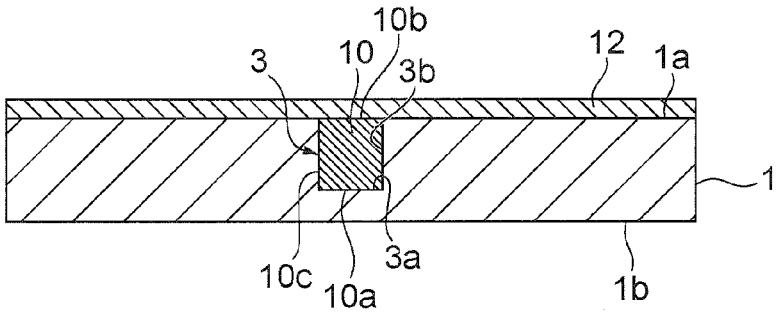

The below will describe a method for producing the X-ray generation target T1 according to the present embodiment, with reference to FIGS. 5 and 6. The method described herein is one to produce the X-ray generation target T1 shown in FIG. 3. FIG. 5 is a flowchart for explaining the method for producing the X-ray generation target according to the present embodiment. FIG. 6 is a schematic diagram for explaining the method for producing the X-ray generation target according to the present embodiment.

The substrate 1 is first prepared (S101) and then the bottomed hole 3 is formed in the prepared substrate 1, as shown in (a) of FIG. 6 (S103). The hole 3 can be made with a known charged beam processing unit, e.g., a Focused Ion Beam (FIB) processing unit. The FIB processing unit is a device configured to apply a focused ion beam onto a sample and remove a surface portion of the sample by sputtering, thereby performing processing of the sample surface. In this step, the focused ion beam (e.g., a beam of ions like $Ga^+$) is made to impinge upon a desired portion on the first principal surface 1*a* of the substrate 1 to remove the surface portion by sputtering.

Next, the target portion 10 is formed in the hole 3, as shown in (b) of FIG. 6 (S105). The target portion 10 is formed herein by depositing the aforementioned metal from the bottom surface 3*a* of the hole 3 toward the first principal surface 1*a*. Since the metal is directly deposited in the hole 3, the target portion 10 is formed so that the first end face 10*a* thereof is in close contact with the bottom surface 3*a* of the hole 3 and the side surface 10*c* thereof is in close contact with the inside surface 3*b* of the hole 3.

The metal is deposited in the hole 3 by applying the focused ion beam onto the hole 3 (bottom surface 3*a*) in a metal vapor atmosphere, using the aforementioned FIB processing unit. The FIB processing unit sprays a material gas onto a portion irradiated with the focused ion beam, so as to deposit a material by FIB excited chemical vapor phase deposition. Therefore, when the material gas used is Tungsten Hexacarbonyl ($W(CO)_6$), tungsten can be deposited as the foregoing metal. When the material gas used is Trimethyl (Methylcyclopentadienyl) Platinum, platinum can be deposited as the foregoing metal. When the material gas used is DimethylGold Hexafluoroacetylacetonate ($C_7H_7F_6O_2Au$), gold can be deposited as the foregoing metal.

Next, the conductive layer 12 is formed as shown in (c) of FIG. 6 (S107). The conductive layer 12 is formed on the first principal surface 1*a* so as to cover the first principal surface 1*a* of the substrate 1 and the second end face 10*b* of the target portion 10. The conductive layer 12 can be formed, for example, using a known microwave plasma CVD system. In this step, the conductive layer 12 is formed by generating and growing diamond particles while doping them with boron, on the first principal surface 1*a* (second end face 10*b*) by microwave plasma CVD, using the microwave plasma CVD system.

The X-ray generation target T1 shown in FIG. 3 is obtained through these steps.

Figure 7:
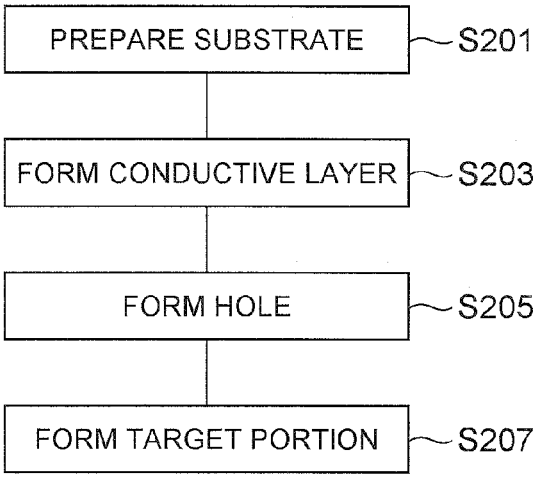
FIG. 7 is a flowchart for explaining a method for producing the X-ray generation target according to the embodiment.
Figure 8:
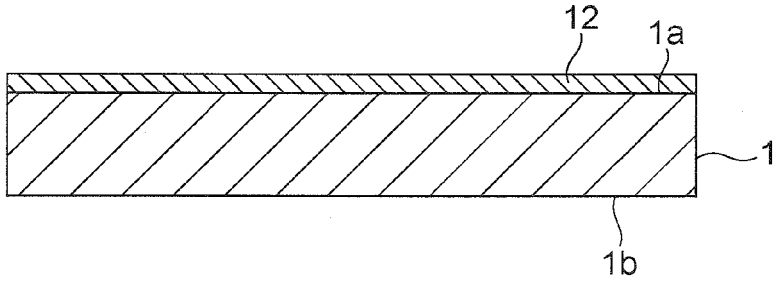
FIG. 8 is a schematic diagram for explaining the method for producing the X-ray generation target according to the embodiment.
Figure 8:
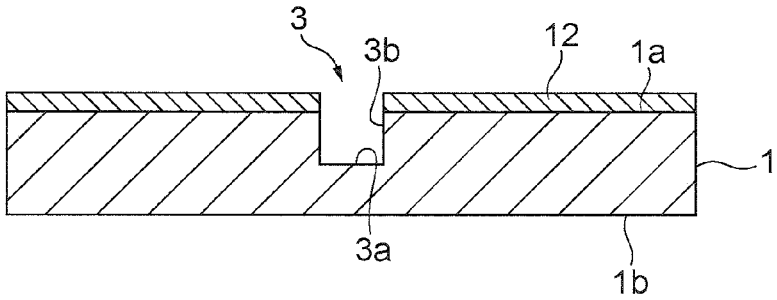
Figure 8:
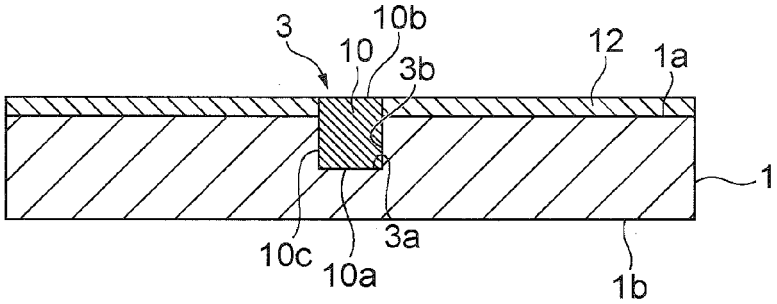

The below will describe another method for producing the X-ray generation target T1 according to the present embodiment, with reference to FIGS. 7 and 8. The method described herein is one to produce the X-ray generation target T1 shown in FIG. 4. FIG. 7 is a flowchart for explaining the method for producing the X-ray generation target according to the present embodiment. FIG. 8 is a schematic diagram for explaining the method for producing the X-ray generation target according to the present embodiment.

First, the substrate 1 is prepared (S201) and the conductive layer 12 is formed on the first principal surface 1*a* of the prepared substrate 1, as shown in (a) of FIG. 8 (S203). The conductive layer 12 can be formed with the microwave plasma CVD system, as described above.

Next, the bottomed hole 3 is formed in the substrate 1 on which the conductive layer 12 is formed, as shown in (b) of FIG. 8 (S205). The hole 3 can be formed with the FIB processing unit, as described above.

Next, the target portion 10 is formed in the hole 3, as shown in (c) of FIG. 8 (S207). The target portion 10 can be formed with the FIB processing unit, as described above.

The X-ray generation target T1 shown in FIG. 4 is obtained through these steps.

Since in the present embodiment the substrate 1 is comprised of diamond as described above, the substrate 1 itself is excellent in thermal conductivity or heat dissipation and is also excellent in stability under high temperature. The coefficient of thermal conductivity of diamond is approximately 2000 W/mK(RT) and is thus larger than ten times the coefficient of thermal conductivity of tungsten (170 W/mK(RT)). The target portion 10 is comprised of the metal deposited from the bottom surface 3*a* of the bottomed hole 3 formed in the substrate 1, toward the first principal surface 1*a*. The entire first end face 10*a* of the target portion 10 is in close contact with the bottom surface 3*a* of the hole 3 and the entire side surface 10*c* of the target portion 10 is in close contact with the inside surface 3*b* of the hole 3. For this reason, there is no hindrance to thermal conduction from the metal making up the target portion 10, to the substrate 1. As a result of these, the X-ray generation target T1 is improved in heat dissipation from the target portion 10 and thus it is prevented from wasting.

In the present embodiment, the target portion 10 is configured so that in the cross section parallel to the direction in which the first and second principal surfaces 1*a*, 1*b* are opposed, the length of the target portion 10 in the opposed direction is set to be not less than the length thereof in the direction perpendicular to the opposed direction. This improves the heat dissipation while reducing the focal-spot diameter determined by the size of the target portion 10.

In the present embodiment the conductive layer 12 is formed on the first principal surface 1*a* side of the substrate 1. This improves the heat dissipation on the first principal surface 1*a* side of the substrate 1 and prevents electrification (charge-up) that can occur when electrons are incident to the first principal surface 1*a* side of the substrate 1.

In the production methods of the present embodiment, the target portion 10 is formed in the substrate 1 in the state in which the first end face 10*a* and side surface 10*c* thereof are entirely in close contact with the hole 3 formed in the substrate 1. As a result of this, the X-ray generation target T1 with improved heat dissipation from the target portion 10 can be readily obtained.

In the production methods of the present embodiment, the target portion 10 is formed by depositing the metal with application of the ion beam to the hole 3 under the metal vapor. This allows the target portion 10 in close contact with the bottom surface 3*a* and the inside surface 3*b* of the hole 3 to be securely formed.

In the production methods of the present embodiment, the hole 3 is formed by applying the ion beam from the first principal surface 1*a* side onto the substrate 1. In this case, the hole 3 can be formed in the substrate 1 with the FIB processing unit used for forming the target portion 10, which can simplify production facilities and steps.

Figure 9:
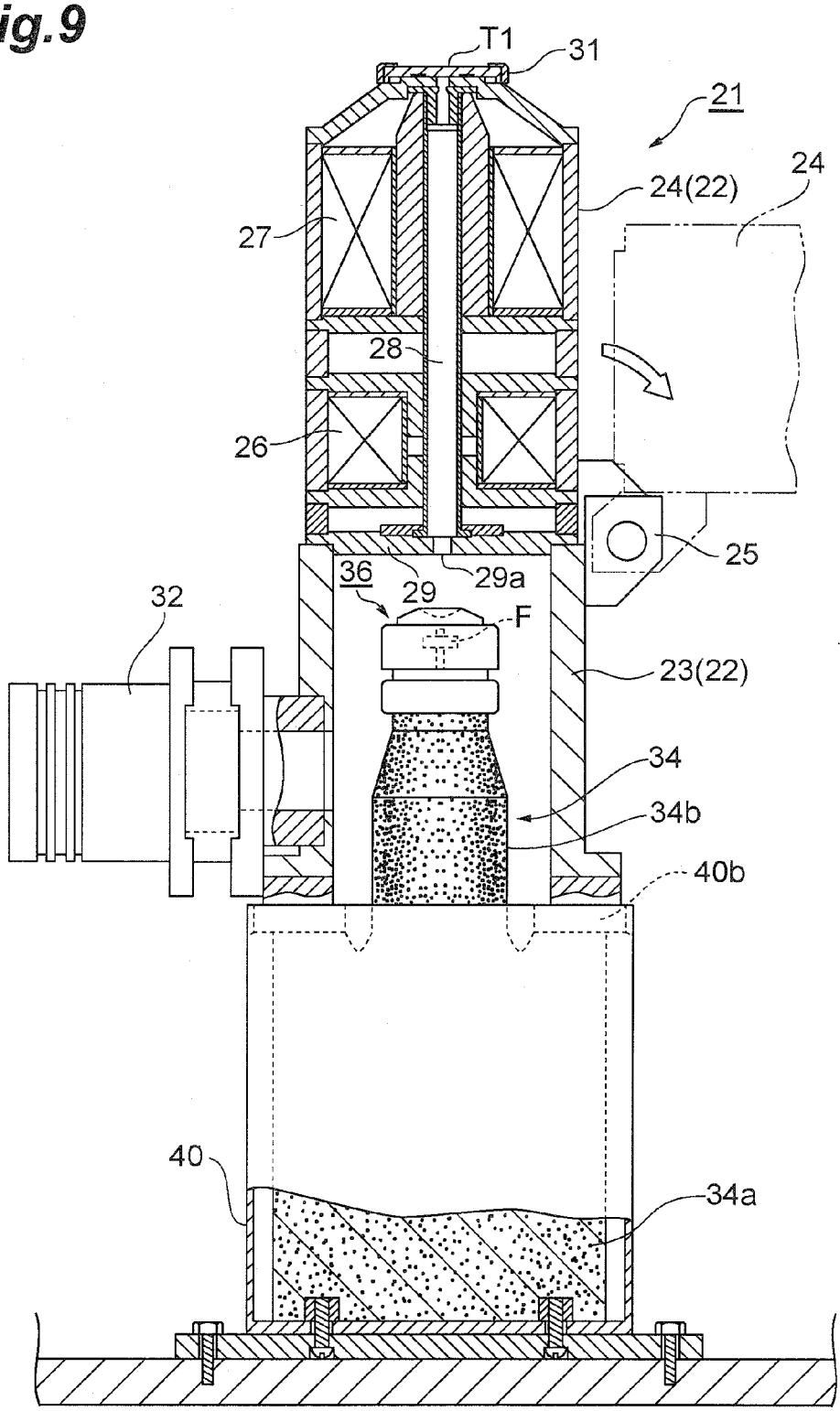
FIG. 9 is a drawing showing a cross-sectional configuration of an X-ray generator according to an embodiment.
Figure 10:
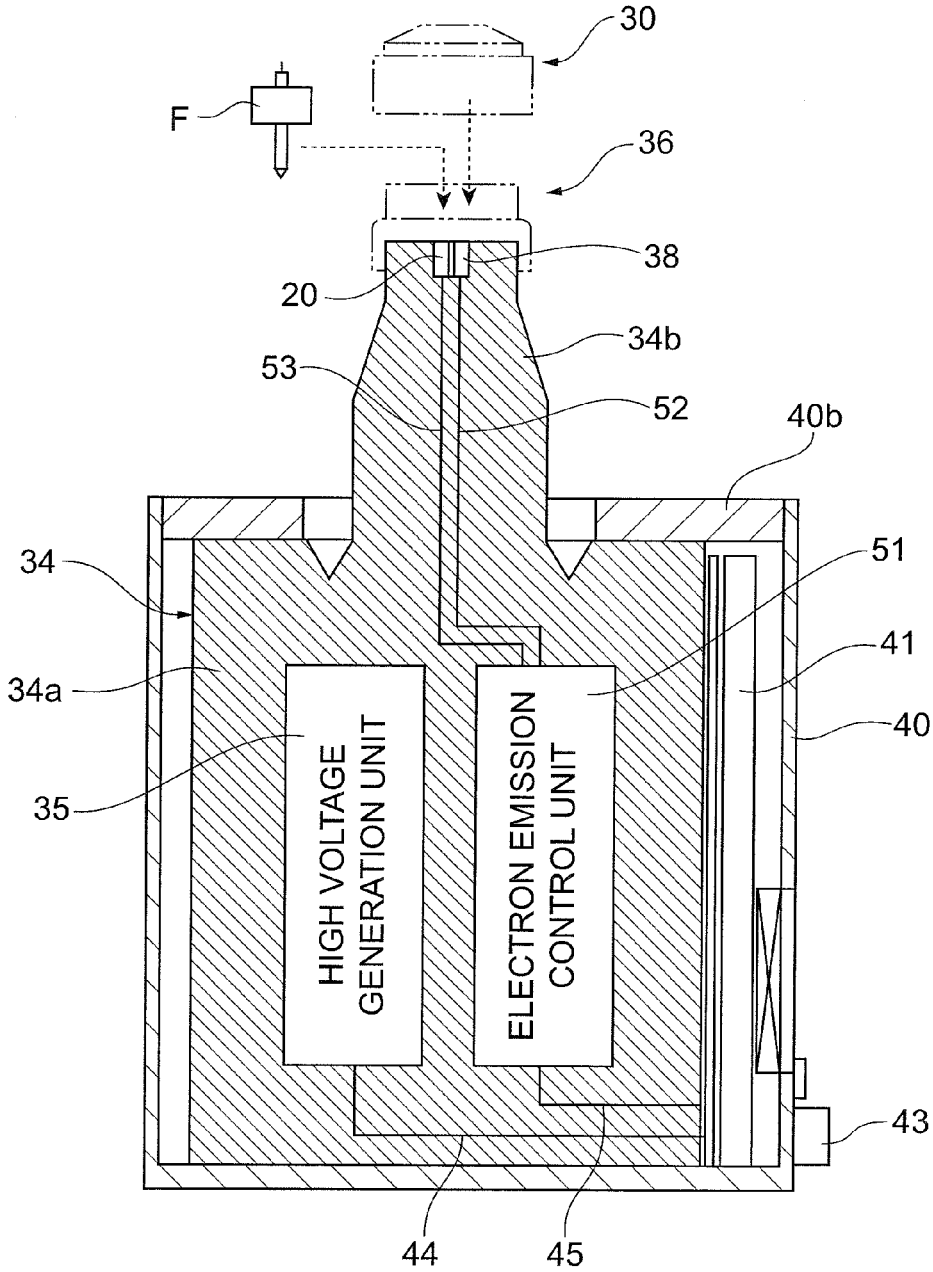
FIG. 10 is a drawing showing a mold power supply unit in the X-ray generator according to the embodiment.

The below will describe an X-ray generator using the X-ray generation target T1, with reference to FIGS. 9 and 10. FIG. 9 is a drawing showing a cross-sectional configuration of the X-ray generator according to the present embodiment. FIG. 10 is a drawing showing a mold power supply unit of the X-ray generator shown in FIG. 9.

As shown in FIG. 9, the X-ray generator 21 is an open type and can optionally create a vacuum state, different from a closed type which is discarded after use. The X-ray generator 21 permits replacement of a filament unit F and the X-ray generation target T1 which are consumables. The X-ray generator 21 has a tubular unit 22 of stainless steel with a cylindrical shape which is brought into a vacuum state during operation. The tubular unit 22 is divided into two sections, a fixed section 23 located down and a detachable section 24 located up. The detachable section 24 is attached to the fixed section 23 through a hinge part 25. Therefore, when the detachable section 24 is rotated into a horizontal posture through the hinge part 25, the upper part of the fixed section 23 becomes open. This makes it possible to access the filament unit (cathode) F housed in the fixed section 23.

A pair of upper and lower tubular coil parts 26, 27 functioning as an electromagnetic deflector lens are provided in the detachable section 24. An electron passage 28 extends in the longitudinal direction of the tubular unit 22 so as to pass the center of the coil parts 26, 27, in the detachable section 24. The electron passage 28 is surrounded by the coil parts 26, 27. A disk plate 29 is fixed to the lower end of the detachable section 24 so as to close it. An electron inlet hole 29*a* is formed in a center of the disk plate 29 so as to be aligned with the lower end of the electron passage 28.

The upper end of the detachable section 24 is formed in a shape of a truncated circular cone. The top of the detachable section 24 is equipped with the X-ray generation target T1 which is located at the upper end of the electron passage 28 and which forms an X-ray exit window of an electron transmission type. The X-ray generation target T1 is housed in an earthed state in a detachable rotary cap part 31. Therefore, when the cap part 31 is removed, the X-ray generation target T1 being a consumable part becomes ready to be replaced.

A vacuum pump 32 is fixed to the fixed section 23. The vacuum pump 32 brings the whole space in the tubular unit 22 into a high vacuum state. Namely, since the X-ray generator 21 is equipped with the vacuum pump 32, it becomes feasible to replace the filament unit F and the X-ray generation target T1 of consumables.

A mold power supply unit 34 integrated with an electron gun 36 is fixed on the base end side of the tubular unit 22. The mold power supply unit 34 is a unit molded from an electrically insulting resin (e.g., epoxy resin) and is housed in a metal case 40. The lower end (base end) of the fixed section 23 of the tubular unit 22 is firmly fixed in a sealed state to an upper plate 40*b* of the case 40 with screws or the like.

A high voltage generation unit 35 constituting a transformer to generate a high voltage (e.g., up to −160 kV in the case where the X-ray generation target T1 is earthed) is sealed in the mold power supply unit 34, as shown in FIG. 10. Specifically, the mold power supply unit 34 is composed of a power supply main body part 34*a* of a block form of a rectangular parallelepiped shape located on the lower side, and a neck part 34*b* of a cylindrical shape projecting upward from the power supply main body part 34*a* into the fixed section 23. Since the high voltage generation unit 35 is a heavy part, it is preferably sealed in the power supply main body part 34*a* and located as low as possible because of a weight balance of the entire X-ray generator 21.

The electron gun 36 is mounted at the distal end of the neck part 34*b* and is arranged so as to face the X-ray generation target T1 with the electron passage 28 in between.

As shown in FIG. 10, an electron emission control unit 51 electrically connected to the high voltage generation unit 35 is sealed in the power supply main body part 34*a* of the mold power supply unit 34. The electron emission control unit 51 controls the timing of emission of electrons, a tube current, and so on. The electron emission control unit is connected through grid connection wire 52 and filament connection wire 53 to grid terminal 38 and filament terminal 20, respectively. The connection wires 52, 53 are sealed in the neck part 34*b* because a high voltage is applied to both.

The power supply main body part 34*a* is housed in the metal case 40. A high voltage control unit 41 is disposed between the power supply main body part 34*a* and the case 40. A power supply terminal 43 for connection to an external power supply is fixed to the case 40. The high voltage control unit 41 is connected to the power supply terminal 43 and is also connected to the high voltage generation unit 35 and to the electron emission control unit 51 in the mold power supply unit 34 through respective wires 44, 45. Based on a control signal from the outside, the high voltage control unit 41 controls the voltage that can be generated at the high voltage generation unit 35 constituting the transformer, from a high voltage (e.g., 160 kV) to a low voltage (0 V). The electron emission control unit 51 controls the timing of emission of electrons, the tube current, and so on.

In the X-ray generator 21, based on control from a controller (not shown), the power and control signal are supplied from the high voltage control unit 41 in the case 40 to each of the high voltage generation unit 35 and the electron emission control unit 51 of the mold power supply unit 34. At the same time as it, the power is also supplied to the coil parts 26, 27. As a result, electrons are emitted at an appropriate acceleration from the filament unit F and the coil parts 26, 27 under control appropriately focus the electrons and apply the electrons onto the X-ray generation target T1. When the applied electrons collide with the X-ray generation target T1, X-rays are radiated to the outside.

Incidentally, a high resolution of the X-ray generator can be achieved by accelerating electrons by a high voltage (e.g., about 50-150 keV) and focusing the electrons to a fine focal spot on the target. As the electrons lose their energy in the target, X-rays, so called bremsstrahlung X-rays, are generated. On this occasion, the focal-spot size is virtually determined by the size of the applied electron beam.

In order to obtain a fine focal-spot size of X-rays, the electrons need to be focused in a small spot. In order to increase an amount of X-rays generated, an amount of electrons needs to be increased. However, by virtue of the space charge effect, the spot size of electrons and an electric current amount are in a conflicting relation and it is thus impossible to flow a large electric current to a small spot. If a large electric current is made to flow to a small spot, the target might waste easy because of heat generation.

In the present embodiment, since the X-ray generation target T1 is provided with the substrate of diamond and the target portion 10 in close contact with the bottom surface 3*a* and the inside surface 3*b* of the hole 3 as described above, the X-ray generation target T1 is extremely excellent in heat dissipation. Therefore, the waste of the X-ray generation target T1 can be prevented even in the aforementioned situation.

The target portion 10 is nanosized. For this reason, even in the case where electrons are applied at the aforementioned high acceleration voltage (e.g., approximately 50-150 keV) and where the electrons become expanded near the target portion 10, the diameter of the X-ray focal spot will not increase, so as to suppress deterioration of resolution. Namely, the resolution achieved is one determined by the size of the target portion 10. Therefore, the X-ray generator 21 using the X-ray generation target T1 can achieve the resolution of nanometer order (several ten to several hundred nm) while increasing the X-ray amount.

Figure 12:
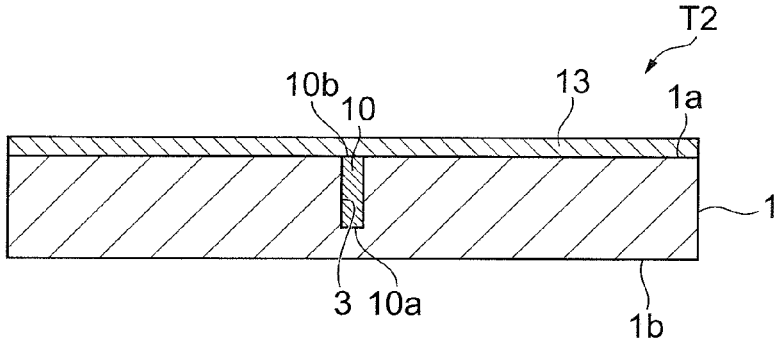
FIG. 12 is a drawing for explaining a cross-sectional configuration of an X-ray generation target according to an embodiment.
Figure 13:
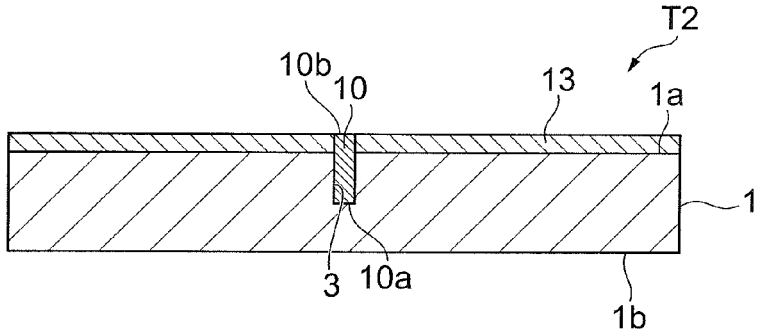
FIG. 13 is a drawing for explaining a cross-sectional configuration of an X-ray generation target according to an embodiment.

An X-ray generation target T2 according to another embodiment of the present invention will be described below with reference to FIGS. 12 and 13. FIGS. 12 and 13 are drawings for explaining cross-sectional configurations of the X-ray generation target according to the present embodiment.

The X-ray generation target T2 is provided with the substrate 1, the target portion 10, and a protecting layer 13, as shown in FIGS. 12 and 13.

The protecting layer 13 is formed on the first principal surface 1*a* side of the substrate 1. The protecting layer 13 is comprised of a first transition element (e.g., titanium, chromium, or the like). If the thickness of the protecting layer 13 is too small, it will become likely to be peeled off from the substrate 1 and it can be difficult to form it with no space. On the other hand, if the protecting layer 13 has heat dissipation lower than that of the substrate 1 and also covers the target portion 10, it can impede incidence of an electron beam to the target portion 10. Therefore, the thickness of the protecting layer 13 is smaller than the height of the target portion 10 (the depth of the hole 3) and is, specifically, 10-100 nm, preferably 20-60 nm, and about 50 nm in the present embodiment. The protecting layer 13 can be formed by vapor deposition such as physical vapor deposition (PVD).

The material making up the protecting layer 13 is preferably one different from those easily peeled off from the substrate 1 of diamond like aluminum. For this reason, the material making up the protecting layer 13 is preferably selected from transition elements such as titanium, chromium, molybdenum, or tungsten. However, if the material is one with high X-ray generation efficiency like tungsten (third transition element) or molybdenum (second transition element) used in the target portion 10, among the transition elements, X-rays generated in the protecting film 13 could affect the focal-spot diameter of the X-rays generated in the target portion 10. For this reason, the thickness of the protecting layer 13 needs to be set as small as possible and control of thickness is difficult during film formation. Therefore, the protecting layer 13 is more preferably comprised of a first transition element such as titanium or chromium, or an electrically conductive compound thereof (titanium carbide or the like), which has the X-ray generation efficiency lower than that of the material making up the target portion 10. In the present embodiment, the protecting layer 13 is formed by depositing titanium in the thickness of about 50 nm.

The protecting layer 13 shown in FIG. 12 is formed on the first principal surface 1*a* so as to cover the first principal surface 1*a* of the substrate 1 and the second end face 10*b* of the target portion 10. The protecting layer 13 shown in FIG. 13 is formed on the first principal surface 1*a* so as to expose the second end face 10*b* of the target portion 10. Namely, the substrate 1 is covered without being exposed, by the protecting film 13 on the electron beam entrance side in the X-ray generation target T2, while the protecting film 13 is not formed on the side faces of the substrate 1 and on the second principal surface 1*b* being the X-ray exit side.

Since the diameter of the target portion 10 (inside diameter of the hole 3) is extremely small, about 100 nm, as described above, the electron beam can be applied directly onto the first principal surface 1*a* of the substrate 1 off the target portion 10. On this occasion, if oxygen remains in an atmosphere in the apparatus and if the electron beam is applied directly to the first principal surface 1*a* of the substrate 1, the substrate 1 will be damaged and it can raise a problem of forming a through hole, in certain cases. For reducing the remaining gas in the apparatus, it is necessary to make various improvements in the housing itself of the apparatus, the evacuation means, and so on, which are not easy. Therefore, it is preferable to protect the substrate from the electron beam by a structure that can be formed on the substrate 1. In contrast to it, when the protecting layer 13 containing the transition element is formed so as to cover the first principal surface 1*a*, the electron beam is prevented from being applied directly to the first principal surface 1*a* and the adhesion between the protecting layer 13 and the substrate 1 is retained, which can prevent the damage of the substrate 1. Furthermore, since the protecting film 13 is not formed on the side faces of the substrate 1 and on the second principal surface 1*b* being the X-ray exit side, good heat dissipation by the substrate 1 can be utilized.

The surface of the protecting layer 13 on the electron beam entrance side also has electrical conductivity. For this reason, the protecting layer 13 has the same function as the conductive layer 12 and thus can prevent electrification that can occur when electrons are incident to the first principal surface 1*a* of the substrate 1.

The X-ray generator 21 can use the X-ray generation target T2, instead of the X-ray generation target T1. When the X-ray generation target T2 is used, the spot size of the electron beam does not have to be made smaller in accordance with the diameter of the target portion 10 because the substrate 1 is protected from the electron beam. Namely, even if the spot size of the electron beam is set larger than the diameter of the target portion 10, the substrate 1 is prevented from being damaged by the electron beam applied off the target portion 10.

The X-ray focal-spot diameter, as described above, is determined by the size (diameter) of the target portion 10. Therefore, even if the spot size of the electron beam is set larger than the diameter of the target portion 10, the X-ray generator 21 using the X-ray generation target T2 can achieve the resolution of nanometer order (several ten to several hundred nm).

The above described the preferred embodiments of the present invention, but it is noted that the present invention is by no means intended to be limited to the above-described embodiments but the present invention can be modified in various ways without departing from the spirit and scope of the invention.

In the embodiment the conductive layer 12 is formed by generating and growing diamond particles while doping them with boron, but the method of forming the conductive layer 12 does not always have to be limited to this method. For example, the conductive layer 12 may also be formed by doping diamond with an impurity (e.g., boron or the like). For example, in the production of the X-ray generation target T1 shown in FIG. 3, the target portion 10 is formed in the hole 3, thereafter a diamond layer is formed by generation and growth of diamond particles on the first principal surface 1*a* (second end face 10*b*) by microwave plasma CVD, and the diamond layer thus formed is doped with boron to form the conductive layer 12. In the production of the X-ray generation target T1 shown in FIG. 4, the first principal surface 1*a* is doped with boron to form the conductive layer 12. It is also possible to form the conductive layer 12 by vapor deposition of an electrically conductive thin film of titanium or the like on the first principal surface 1*a* (second end face 10*b*).

Figure 11:
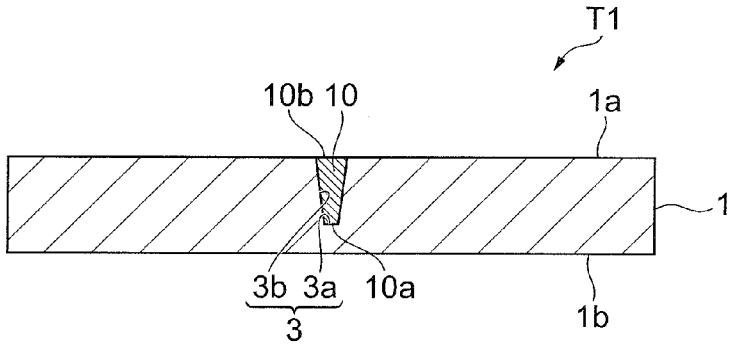
FIG. 11 is a drawing for explaining cross-sectional configurations of modification examples of the X-ray generation target according to the embodiment.
Figure 11:
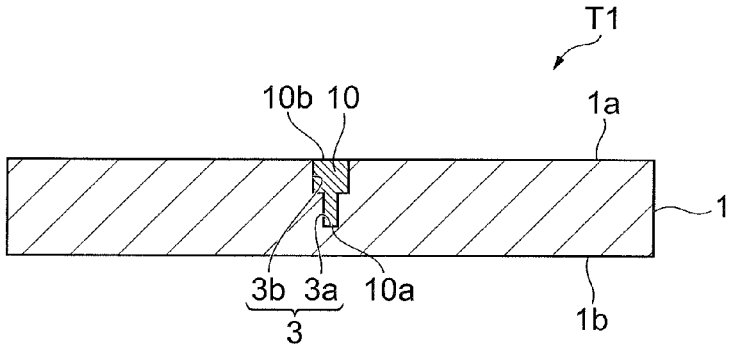

The inside space of the hole 3 is not limited to the aforementioned cylindrical shape or prismatic shape, but may be a truncated cone shape (e.g., a truncated circular cone, a truncated pyramid shape, or the like) as shown in FIG. 11(*a*) or may be a columnar shape (e.g., a cylindrical shape, a prismatic column shape, or the like) with plural steps (e.g., two steps or the like) as shown in FIG. 11(*b*). In the hole 3 shown in FIG. 11(*a*), the diameter of the bottom surface 3*a* is set smaller than the diameter of the opening end of the hole 3 and the inside surface 3*b* is inclined in a taper shape. Therefore, the target portion 10 has a truncated circular cone shape in which the outside diameter of the first end face 10*a* is smaller than that of the second end face 10*b*. In the hole 3 shown in FIG. 11(*b*), the inside space is composed of a first interior space on the bottom surface 3*a* side and a second interior space on the opening end side, and the inside diameter of the first interior space is set smaller than that of the second interior space. Therefore, the target portion 10 has a two-stepped circular column shape. In the case of the X-ray generation target T1 according to the modification examples shown in FIGS. 11(*a*) and (*b*), it is easy to perform processing of the hole 3 and to perform formation of the target portion 10 (deposition of metal).

The protecting layer 13 does not always have to cover the entire area of the first principal surface 1*a* of the substrate 1. The protecting layer 13 may be formed only over a region where the electron beam is highly likely to impinge (e.g., a surrounding region around the target portion 10) and does not have to be formed in a region where the electron beam is unlikely to impinge (e.g., an edge region of the substrate 1). In this case, it is feasible to make use of good heat dissipation by the substrate 1.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An X-ray generation target for generating an X-ray with incidence of an electron beam comprising:

a substrate comprised of diamond and having first and second principal surfaces opposed to each other and a bottomed hole formed from the first principal surface;

a target portion comprised of a metal deposited from a bottom surface of the hole toward the first principal surface and having a side surface wholly in close contact with an inside surface of the hole; and a protecting layer protecting the substrate from the electron beam and containing a transition element, the protecting layer is formed on the first principal surface of the substrate.

2. The X-ray generation target according to claim 1, wherein the target portion is formed so that in a cross section parallel to a direction in which the first and second principal surfaces are opposed, a length of the target portion in the direction in which the first and second principal surfaces are opposed is set to be not less than a length thereof in a direction perpendicular to the direction in which the first and second principal surfaces are opposed.

3. The X-ray generation target according to claim 1, wherein the transition element is a first transition element.

4. An X-ray generator comprising:

the X-ray generation target as set forth in claim 1; and an electron beam applying unit which applies an electron beam to the X-ray generation target.

5. The X-ray generation target according to claim 1, wherein a surface of the protecting layer has electrical conductivity.

6. A method for producing X-ray generation target for generating an X-ray with incidence of an electron beam, comprising:

a step of preparing a substrate comprised of diamond and having first and second principal surfaces opposed to each other;

a step of forming a bottomed hole from the first principal surface in the substrate; and a step of depositing a metal from a bottom surface of the hole toward the first principal surface to form a target portion in the hole, wherein the step to form the target portion comprises applying an ion beam to the hole in a metal vapor atmosphere and spraying a material gas containing the metal onto a portion irradiated with the ion beam, so as to deposit the metal by a chemical vapor phase deposition.

7. The method according to claim 6, wherein the step of forming the hole comprises applying a charged beam to the substrate from the first principal surface to form the hole.

8. The method according to claim 7, wherein the charged beam is an ion beam.

9. An X-ray generation target for generating an X-ray with incidence of an electron beam comprising:

a substrate comprised of diamond and having first and second principal surfaces opposed to each other and a bottomed hole formed from the first principal surface; and a target portion comprised of a metal deposited from a bottom surface of the hole toward the first principal surface, wherein a diameter of the bottom surface is set smaller than a diameter of an opening end of the hole.

10. The X-ray generation target according to claim 9, wherein an inside surface of the hole is inclined in a taper shape.

11. The X-ray generation target according to claim 9, wherein the target portion has a truncated circular cone shape.

12. The X-ray generation target according to claim 9, wherein an inside space is composed of a first interior space on the bottom surface side and a second interior space on an opening end side, and an inside diameter of the first interior space is set smaller than that of the second interior space.

13. The X-ray generation target according to claim 9, wherein the target portion has a two-stepped circular column shape.

14. The X-ray generation target according to claim 9, further comprising:

a protecting layer protecting the substrate from the electron beam and containing a transition element, the protecting layer is formed on the first principal surface of the substrate.

15. The X-ray generation target according to claim 14, wherein the transition element is a first transition element.

* * * * *